US005505149A

United States Patent [19]

Schramayr et al.

[11] Patent Number: 5,505,149

[45] Date of Patent: Apr. 9, 1996

[54] METHOD AND APPARATUS FOR ATTACHING SLEEVES TO SHIRT BODIES

[75] Inventors: Ernst Schramayr, Barneveld; Tadeusz A. Olewicz, New Hartford; Robert J. Sheets; Andrew T. Colerick, both of Utica, all of N.Y.

[73] Assignee: Jet Sew Technologies, Inc., Bowling Green, Ky.

[21] Appl. No.: 423,316

[22] Filed: Apr. 18, 1995

[51] Int. Cl.[6] ..... D05B 27/10; D05B 35/02; D05B 25/00

[52] U.S. Cl. ..... 112/470.29; 112/155; 112/322; 112/475.09

[58] Field of Search ..... 112/475.09, 475.12, 112/63, 470.29, 470.31, 470.18, 470.36, 470.03, 141, 147, 157, 155, 470.14, 303, 304, 305, 306, 318, 322, 475.02, 475.04, 474.07

[56] References Cited

U.S. PATENT DOCUMENTS

| | | | |
|---|---|---|---|
| 3,783,805 | 1/1974 | Guichary | 112/322 X |
| 4,046,087 | 9/1977 | Manetti | 112/470.18 |
| 4,467,734 | 8/1984 | Rohr | 112/63 |
| 4,473,017 | 9/1984 | Letard et al. | 112/141 |
| 4,479,447 | 10/1984 | Rohr | 112/141 |
| 4,512,268 | 4/1985 | Rohr | 112/63 |
| 4,665,848 | 5/1987 | Michaels et al. | 112/306 X |
| 4,714,036 | 12/1987 | Raisin et al. | 112/147 |
| 4,827,856 | 5/1989 | Rohr | 112/63 |
| 4,883,005 | 11/1989 | Wehmeyer | 112/63 |
| 4,957,054 | 9/1990 | Sakuma et al. | 112/470.36 |
| 5,251,557 | 10/1993 | Rohr | 112/306 |
| 5,269,239 | 12/1993 | Adamski, Jr. et al. | 112/470.29 |
| 5,289,788 | 3/1994 | Fukumoto | 112/470.03 |
| 5,349,913 | 9/1994 | Schramayr et al. | 112/475.09 X |
| 5,370,072 | 12/1994 | Adamski, Jr. | 112/470.03 |
| 5,419,268 | 5/1995 | Fyler et al. | 112/470.14 |

FOREIGN PATENT DOCUMENTS

| | | |
|---|---|---|
| 61-45477 | 10/1986 | Japan . |
| 63-29692 | 2/1988 | Japan . |

*Primary Examiner*—C. D. Crowder
*Assistant Examiner*—Ismael Izaguirre
*Attorney, Agent, or Firm*—Schweitzer Cornman & Gross

[57] ABSTRACT

A method and apparatus for sewing sleeve sections to a knitted shirt body. The sleeve sections are provided with a right-side-out orientation and are engaged and supported for sewing by a limited edge margin. A shirt body, supplied in an inside-out orientation, is applied over a previously loaded sleeve section, and is also engaged by only a limited edge margin at the sleeve opening, with the shoulder margin of the shirt body closely surrounding and approximately aligned with the edge margin of the sleeve section. The two components are placed under limited tension to equalize the respective circumference dimensions and are controllably advanced while a shoulder seam is sewn. The respective edges are guided and aligned as they approach the sewing position. A pair of opposed fixtures and sewing heads are provided at each sewing station, so that both sleeve sections and both sides of the shirt body can be loaded in preparation for sewing. Sewing then can proceed at each side sequentially or simultaneously, depending upon configuration of the sewing heads. In a two-station installation, sewing can take place at one station while the operator loads a shirt body and sleeve sections into a second station. Exceptionally high rates of production can be achieved with relatively simplified and economical equipment installations. The system is adaptable for both long-sleeved and short-sleeved shirts.

27 Claims, 12 Drawing Sheets

FIG. 5
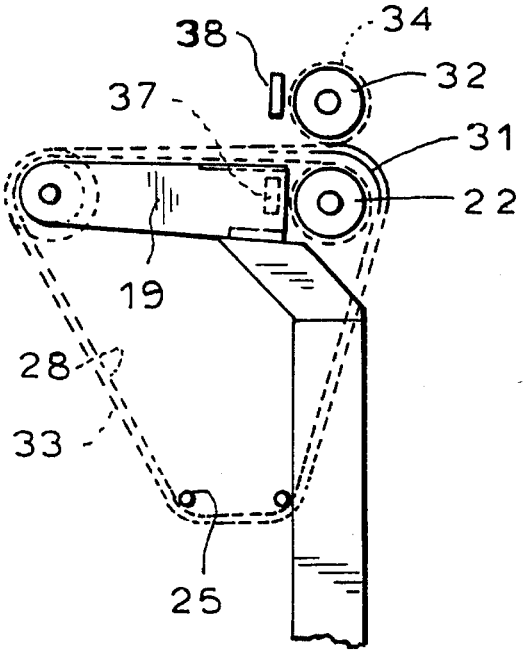
FIG. 3
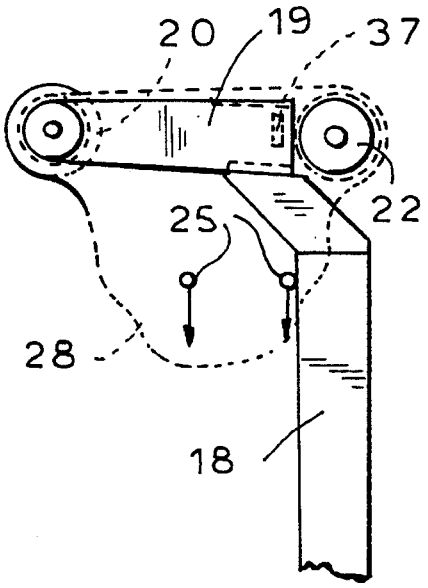
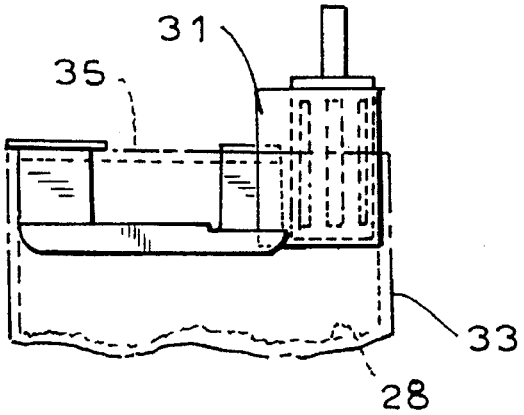
FIG. 6
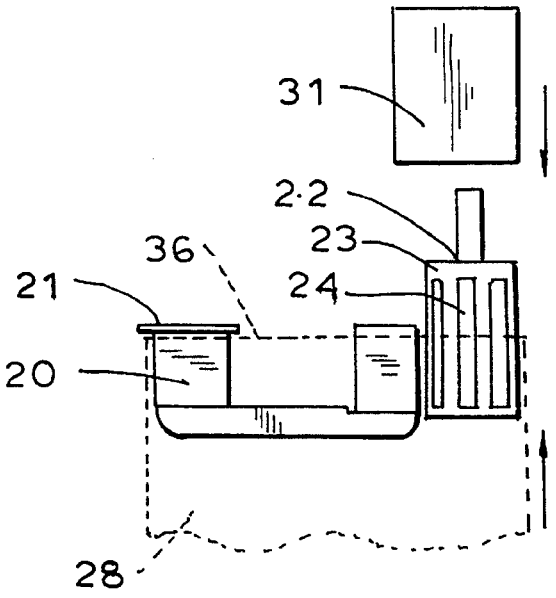
FIG. 4

FIG. 12
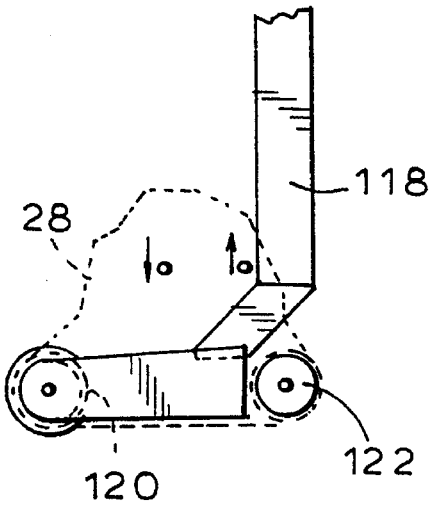
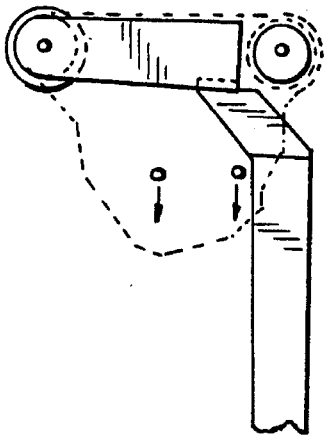
FIG. 11
FIG. 14
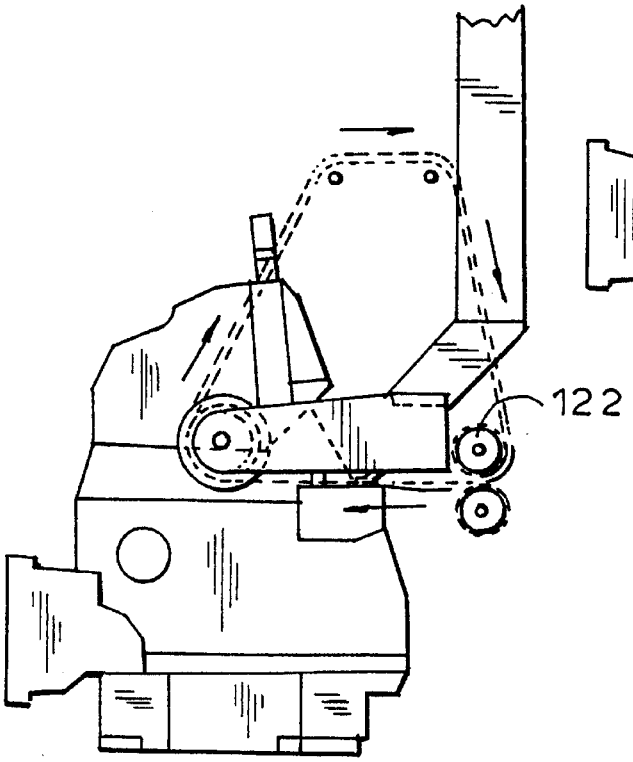
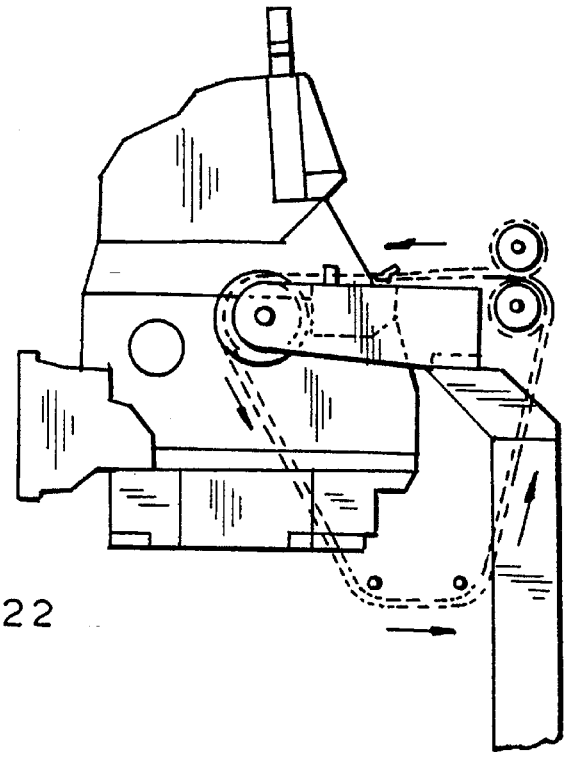
FIG. 13

METHOD AND APPARATUS FOR ATTACHING SLEEVES TO SHIRT BODIES

RELATED CASES

This application is related to the copending U.S. Application of Ernst Schramayr et al., Ser. No. 08/328,738, filed Oct. 25, 1994.

BACKGROUND AND SUMMARY OF THE INVENTION

One of the most difficult procedures in the manufacture of knitted T-shirts has been the attachment of tubular sleeve sections to knitted shirt bodies. In a typical manufacturing procedure for the production of knitted T-shirts, it is customary for shirt bodies and sleeve sections to be separately produced and brought together at a so-called sleeve insertion operation, at which the individual sleeve sections are sewn to the shirt body. The shirt bodies are formed with sleeve openings at opposite sides, and the sleeve sections, previously hemmed at their outer ends, are joined at their raw inner ends to the sleeve openings of the shirt body.

Manual sewing of the sleeve sections to the shirt body is labor-intensive and adds considerable cost to the production of the shirt. Accordingly, significant effort has been made to automate the sleeve insertion procedure, with the objective of enabling it to be performed reliably, with a satisfactory quality level, and at a sufficiently high speed to justify the capital expense of the required equipment.

One of the early efforts to automate the sleeve attachment procedure is reflected in the Ernst Schramayr et al. U.S. Pat. No. 5,329,919, assigned to Jet Sew Technologies, Inc., Barneveld, N.Y. In that patented system, a shirt body is placed over a cylindrical body form, which presents the sleeve openings at opposite ends of the form, with the shirt body oriented right-side-out. Sleeve sections are then applied, with an inside-out orientation, hem end first, over the cylindrical body form. Procedures are followed during the application steps to align the raw edges of each shoulder opening and each associated sleeve in a predetermined plane. In a subsequent operation, the two parts are sewn together by operating a sewing head in a circular path about the aligned edges of the sleeve sections and sleeve openings.

Although the system of the '919 patent is an improvement over procedures previously available, a problem has been observed. This problem arose from the necessity of applying the pre-hemmed sleeve section externally over the shirt body supported on a cylindrical form. In some cases, this results in overstretching of the sleeve section, particularly since, in many cases, the hemmed edge of the sleeve section is of smaller diameter than the raw edge to be joined with the sleeve opening.

The problem that is observed in the system of the above mentioned U.S. Pat. No. 5,349,919 is addressed in a subsequent development, which forms the subject matter of copending application Ser. No. 08/294,095, filed Aug. 22, 1994. In the system of the copending application, provision is made for loading of the sleeve sections onto tapered sleeve cones which are then positioned on the inside of a body form, rather than over the outside as in the system of the '919 patent. A shirt body is then loaded over the body form, and the aligned edges of the sleeve sections and shirt bodies are sewed by a circular movement of the body form relative to a sewing head.

While in the patented apparatus, the sewing head itself is caused to traverse through a circular path for sewing the shoulder seam, in the apparatus of the pending application, the loaded body form preferably is detached from its loading position and the body form itself is caused to rotate relative to a fixed sewing head.

The system of the pending application represents an improvement over the patented apparatus in that the sleeve sections are exposed to less stretching. They are nevertheless still exposed to some degree of stretching in order to load them onto the conical sleeve cones. In addition, and possibly more importantly, the various body and sleeve forms utilized in the operation are size specific. Accordingly, a plurality of sets of forms are required for the manufacture of a full range of shirt sizes, which adds to the capital requirements of the system.

The method and apparatus of the present invention address and eliminate the problems observed in the earlier systems described above, enabling the sleeve insertion operation to be accomplished with a considerably reduced cycle time, and with much simpler, less costly equipment. In accordance with procedure of the invention, each sewing location is provided with a load fixture which receives and supports only a narrow marginal portion of the raw (shoulder) edge of a sleeve section, allowing the hemmed end of the sleeve section to hang free. The shoulder section of a shirt body is then loaded over the sleeve section, and a narrow margin of fabric adjacent the sleeve opening is supported in surrounding relation to the previously loaded sleeve section. Only the shoulder edge margin of the shirt body is engaged and supported. For each of the edge margins, there is provided an edge sensing element, and an active edge guide device which responds to signals from the edge sensing element and serves to independently align the respective fabric edges on a continuous basis.

After loading of the sleeve and body sections, a sewing head is activated, and the edge margins of the sleeve and body sections are advanced past the needle position of a stationary sewing head to enable the sewing operation to take place. As the sewing progresses, the edges of the sleeve section and shirt body are automatically and independently aligned, immediately in advance of sewing. Among other things, this allows the machine operator to load the sleeve section and shirt body onto the load fixture with relatively minimum regard for precise initial alignment.

In a preferred form of the invention, each sewing station comprises a pair of generally opposed load fixtures and sewing heads, and the operator first loads a sleeve section and shirt body at one side, and then loads a second sleeve section and the opposite side of the shirt body on a second load fixture. The sewing operations then proceed, either sequentially or simultaneously, depending on the configuration of the equipment. The equipment required is size independent, with each load fixture advantageously consisting of a series of support rollers, including at least one such roller that is movable to place both fabric sections under light circumferential tension. This serves to equalize the circumferences of the sleeve and the shirt body shoulder opening, and also to facilitate edge guidance during sewing. The result is a high quality, pleat-free seam. Desirably, the movable roller means are retracted to accommodate the initial loading of a sleeve section, and thereafter moved to a position to place the fabric under the desired light tension for sewing.

In a preferred form of the invention, the load fixtures are pivotable to a position at least partially facing the machine operator, in order to facilitate the loading operations. Thereafter, the load fixtures can be pivoted to positions aligned with respect to a common axis to better accommodate the subsequent sewing operations.

Pursuant to the invention, a relatively simple, yet highly efficient sleeve insertion installation may be provided by arranging two sets of equipment adjacent to each other and preferably arranged at an angle, so that a single operator may load one station and, while that station is performing the necessary sewing operations, the operator can load the adjacent second station. The procedures according to the invention enable greatly reduced cycle times, representing a major improvement over procedures heretofore known. At the same time, the equipment required is far simpler and less costly.

For a more complete understanding of the above and other features and advantages of the invention, reference should be made to the following detailed description of preferred embodiments of the invention and to the accompanying drawings.

DESCRIPTION OF THE DRAWINGS

FIGS. 3 and 4 are fragmentary front elevation and top plan views of the load fixture of FIG. 2 with components thereof positioned for loading of sleeve and shirt body sections onto the load fixture.

FIGS. 5 and 6 are views, corresponding to FIGS. 3 and 4 respectively, showing the machine elements after loading of the elements to be sewn.

FIGS. 11 and 12 are fragmentary elevational views of the opposed load stations of the system of FIG. 10 as configured for the initial loading.

FIGS. 13, 14 are views similar to FIGS. 11, 12, showing the configuration of the load fixtures after loading and with the sewing heads in position.

DESCRIPTION OF PREFERRED EMBODIMENTS

Figure 1:
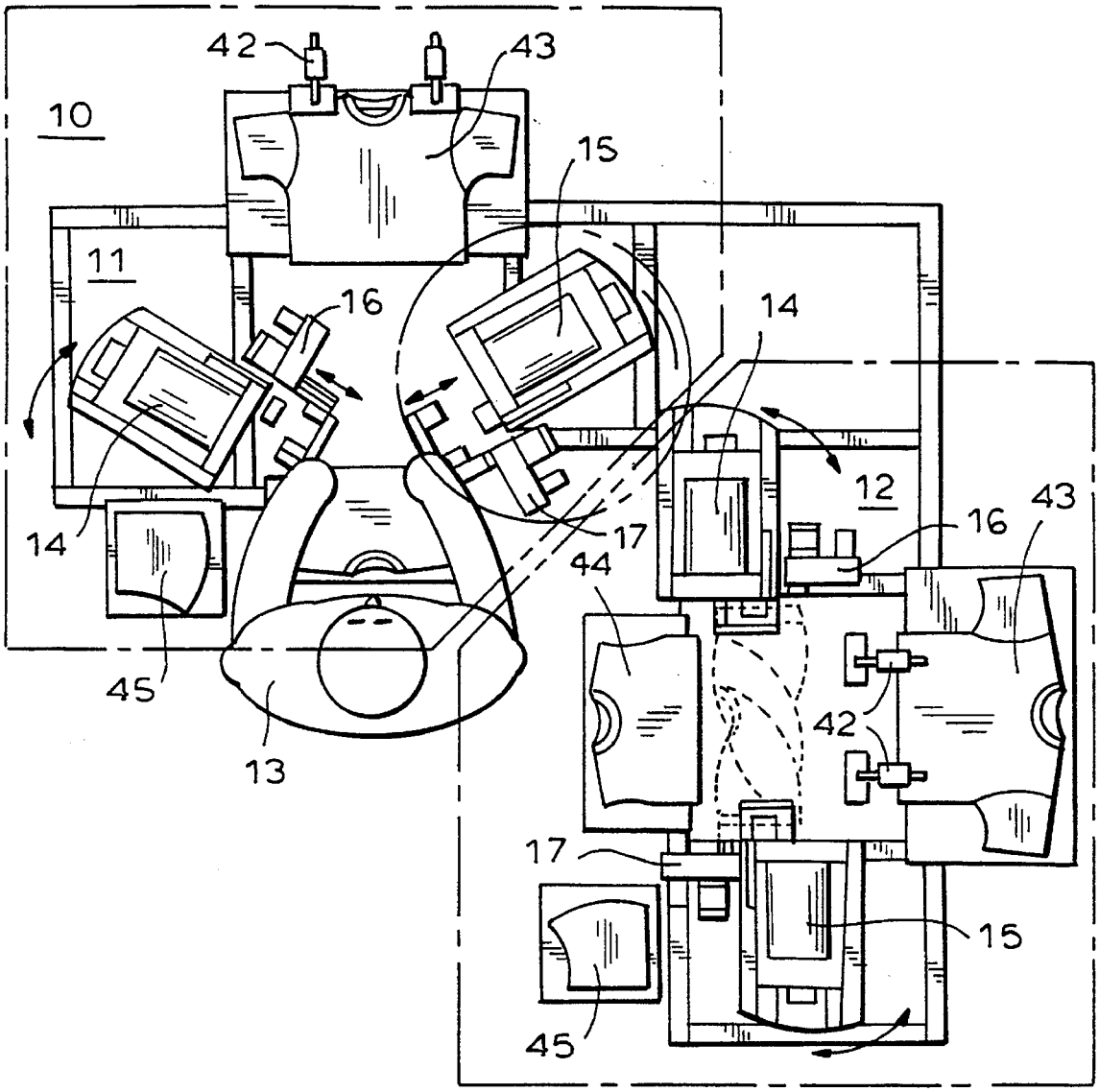
FIG. 1 is a top plan view of a preferred embodiment of the invention, showing a two-station installation for sewing sleeve sections to shirt bodies in accordance with the principles of the invention.

Referring now to the drawings, and initially to FIGS. 1–8, the reference numeral 10 designates generally a two-station sewing installation according to the present invention. Each of the sewing stations 11,12 is of similar construction and arrangement and thus only one will be described in detail. As shown in FIG. 1, the two stations 11,12 advantageously may be arranged at right angles to each other, such that a single operator 13 can stand in a position essentially in front of both stations, so as to be able to service both stations by simply turning from one to the other while standing generally in the same location.

Each of the sewing stations comprises a pair of opposed sewing heads 14,15, each with a related load fixture generally designated by the numerals 16,17, which are movable toward and away from the respective sewing heads 14,15 for sewing and loading operations respectively.

To advantage, each of the sewing heads 14,15, and their respective load fixtures 16,17 are mounted for pivoting movement between loading positions and sewing positions. In the illustration of FIG. 1, the sewing station 11 has its sewing heads oriented toward the operator 13, to facilitate the operations involved in the loading of shirt elements to be sewn. In the same figure, the sewing station 12 illustrates its corresponding sewing heads 14,15 and their related load fixtures 16,17 pivoted to a position aligned in directly opposed relation, which is preferred for conducting the sewing operations.

With reference to FIGS. 2–6, showing details of the sewing head 15 and load fixture 17, the load fixture includes a main support 18 which mounts a generally horizontally disposed sewing shutter 19. At one end of the shutter, there is a guide roller 20, which is rotatably supported by the shutter and has a guide flange 21 adjacent its back edge. The guide roll is located at the exit end of the sewing shutter 19, as will appear more fully hereinafter.

At the opposite or entry end of the sewing shutter there is a guide roller 22 which is in the form of an active edge aligning roller device. The active alignment device may be any one of several known devices for this purposes which comprise a rotary body member 23, which can be driven to rotate at a desired speed (normally synchronous with the sewing head) and which mounts a plurality of circumferentially spaced positioning elements 24, which may be in the form of wheels, belts, feed dogs or the like. These positioning elements are arranged to contact a fabric margin passing thereover and, in response to the sensed position of the edge of such a fabric, to move the edge axially of the guide roller, to position it in a desirable alignment for sewing. Examples of such devices, which are well known in the art, are reflected in the Wehmyer U.S. Pat. No. 4,883,005 as well as the Rohr U.S. Pat. No. 5,251,557.

Also mounted on the support 18 are guide rollers 25 which are carried by a movable bracket 26. The bracket 26 is controllably movable by means, such as an air cylinder (not shown) for example enabling the guide rollers to be moved toward the sewing shutter 19 for loading purposes and away from the sewing shutter for applying limited controlled tension to a fabric section. As shown particularly in FIG. 2, the guide rollers 25, which typically are idler rollers, are of frustoconical configuration, being of larger diameter toward the front and smaller diameter toward the back, and having guide flanges 27 at the back edges.

Figure 2:
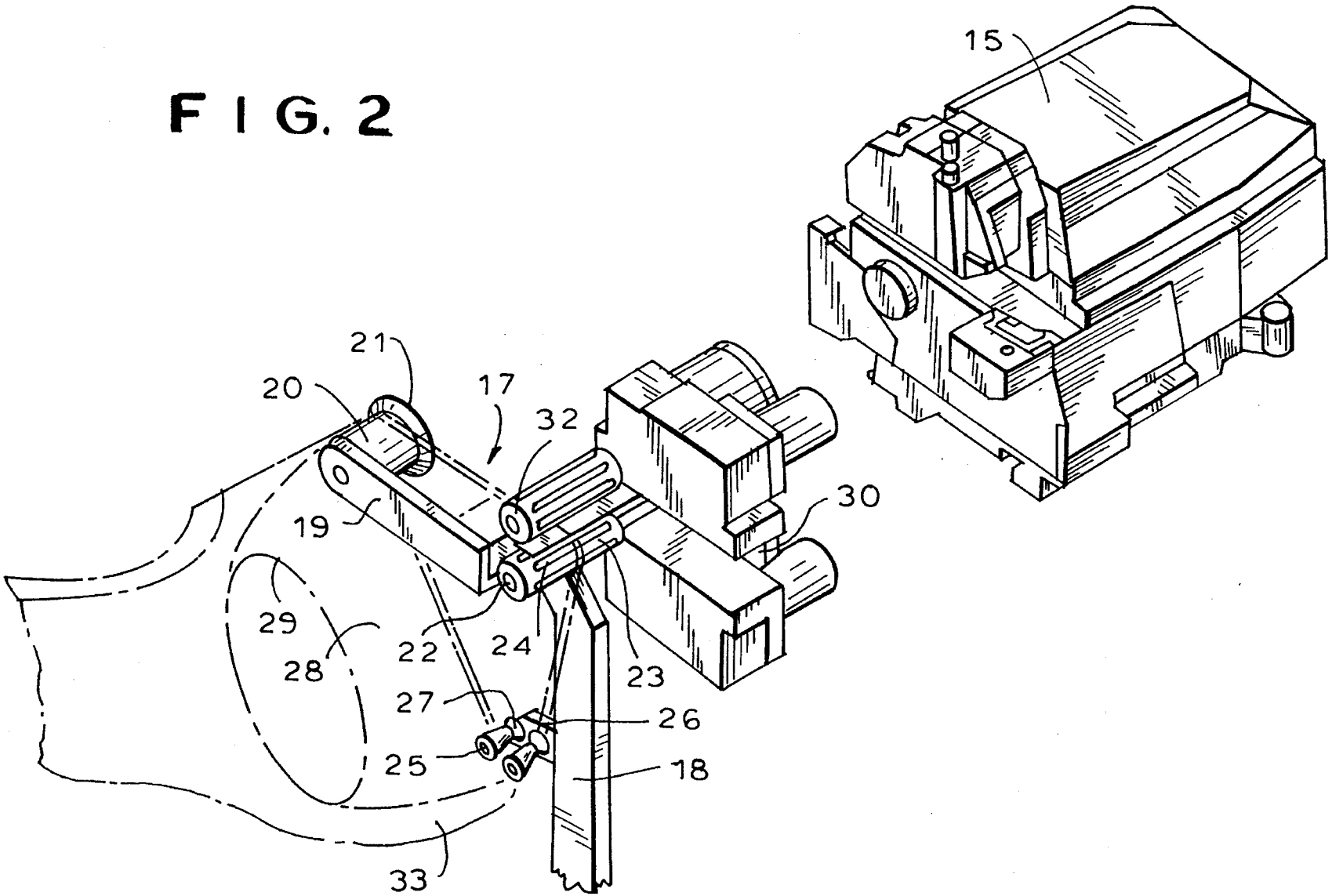
FIG. 2 is an exploded perspective view showing details of a load station according to the invention for loading of a sleeve section and one side of a shirt body in preparation for sewing.

In the system of FIG. 2, a tubular sleeve section 28, with its hemmed edge 29 at its outer side (to the left in FIG. 2) has its raw or shoulder edge margin applied over the guide rollers 20,22 and 25 generally as shown in FIG. 2. Also as shown in FIG. 2, the various guide rollers are relatively short in relation to the length of the sleeve section 28, so that only a narrow marginal edge portion of the sleeve section is carried by the various guide rollers.

To facilitate loading of the sleeve section, the bracket 26 initially can be urged upwardly by its actuator, to position the guide rollers 25 at an elevated location, substantially as shown in FIG. 3. Thereafter, the bracket 26 may be lowered, under a controlled light force, to place a light circumferential tension on the marginal edge of the sleeve section supported by the guide rollers. Among other things, this stabilizes and holds the sleeve section 28 during the subsequent loading of a shirt body shoulder over the outside of the sleeve section.

As will be discussed further, the sleeve section 28 is caused to be advanced throughout at least one complete revolution during a sewing operation partly by driving the active guide roller 22, which may be done by means of a motor 30, and partly by the conventional feed dogs at the sewing head. Because of the frustoconical shape of the lower guide rollers 25, the edge of the sleeve section is automatically urged toward the guide flanges 27 at the back, serving to roughly position the sleeve edge in a desired alignment. In addition, edge sensing detector means, shown schematically at 37 in FIG. 4 serve to determine the position of the fabric edge as the fabric moves from the active guide roller 22 toward the roller 20 at the opposite end of the sewing shutter 19. If the edge sensor 37 detects that the fabric edge is misaligned laterally, in either direction, the controllable alignment elements 24 on the active guide device 22 are correspondingly actuated to shift the fabric edge back toward the desired alignment.

In the process of the invention, after placing the sleeve section 28 in position over the guide rollers 20,22 and 25, a retractable separator plate 31 is moved outward, to a position closely overlying the active guide roller 22 and the sleeve edge margin passing thereover. At the same time, a second active guide roller 32, which preferably moves with the separator plate 31, moves into a position overlying the separator plate and the first active guide roller 22. The operator then applies the shoulder opening margin of a shirt body 33 over the guide rollers 20 and 25 and over the separator plate 31, but under the upper active guide roller 32. As will be noted in FIG. 2, the shoulder edge margin of the shirt body entirely surrounds the sleeve element 28. The shirt body is applied with an inside-out fabric orientation, while the sleeve section 28 is applied with a right-side-out orientation.

To advantage, the shirt body is loaded by applying the shoulder margin first over the tensioning guide rollers 25 and then over the guide roller 20 and separator plate 31. Once the shirt body is installed as described, the upper active guide roller 32 is lowered into contact with the fabric edge, with the fabric being confined between the separator plate 31 and the upper active guide roller 32. At the same time, the lower guide roller 22 is moved upward (or the separator plate 31 is moved downward), so that the sleeve edge is confined between the underside of the separator plate 31 and upper portions of the lower guide roller 22. The upper guide roller 32, like the lower guide roller 22, is provided with circumferentially spaced positioning elements 34 which are controllably actuated to move the shirt body edge, indicated by the reference numeral 35 in FIG. 6, as required in response to signals from a second edge sensor 38, positioned above the separator plate.

In the system of the invention, the sleeve edge, indicated by 36 in FIG. 4, and the shoulder edge 35 of the shirt body are independently aligned by their respective active edge alignment devices 22,32. These in turn are independently controlled by separate edge sensors 37,38 which detect the respective edges 35,36 in the region where the two fabrics are separated by the separator plate 31.

After loading of a sleeve and shirt body at one side, as described in connection with FIGS. 2–6, the same procedure is followed at the opposite side, and a second sleeve section 28 and the opposite side shoulder opening of the shirt body 33 are loaded onto the load fixture 16 associated with the sewing head 14.

Figure 7:
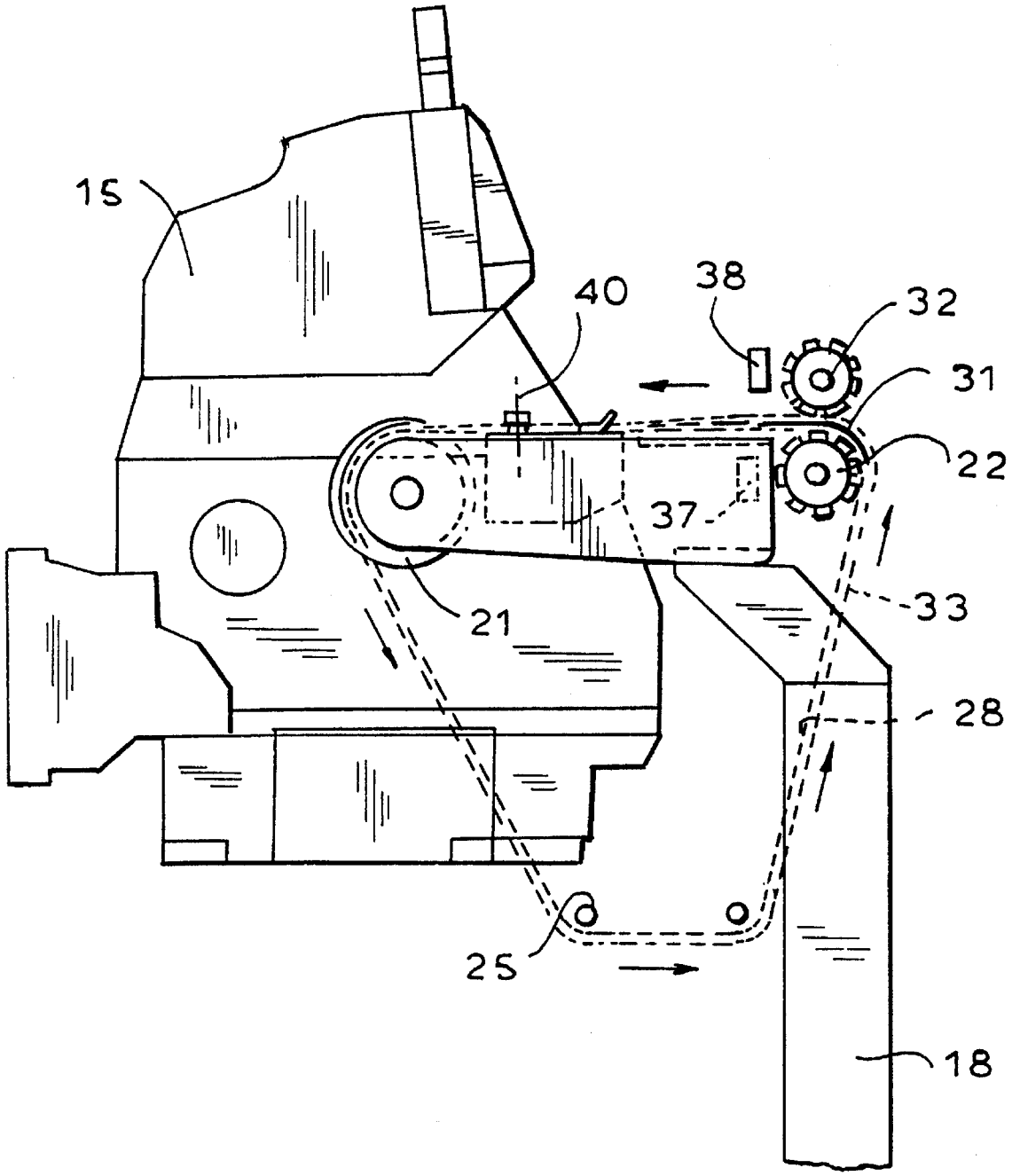
FIG. 7 is an illustration, similar to FIG. 5, showing the sewing head position for sewing of the loaded sleeve and shirt body elements.
Figure 8:
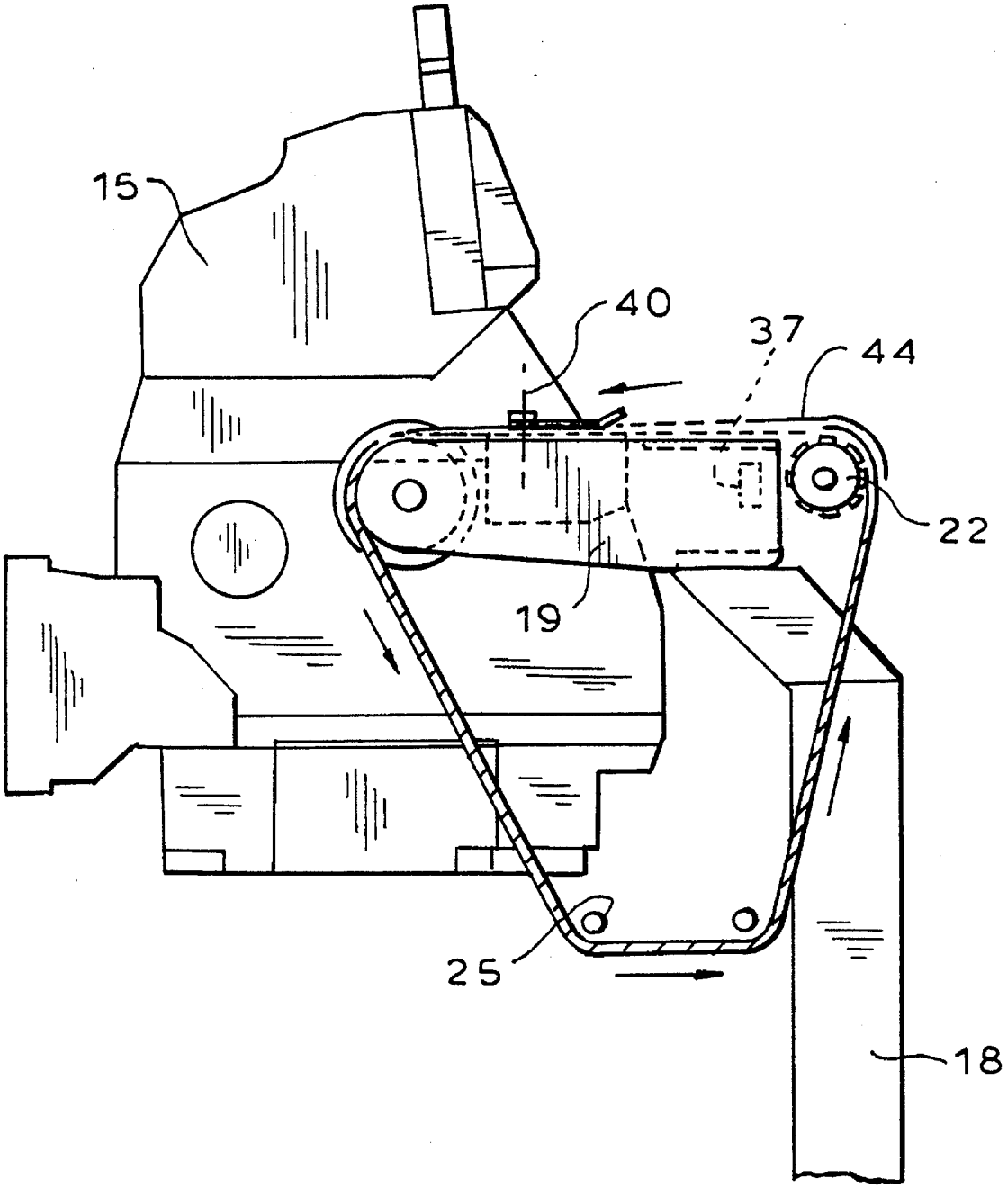
FIG. 8 is a view, similar to FIG. 7, illustrating the equipment as configured near the end of a sewing operation, after retraction of a separator plate from between the sleeve section and shirt body, and retraction of one of the active edge guide devices.
Figure 9:
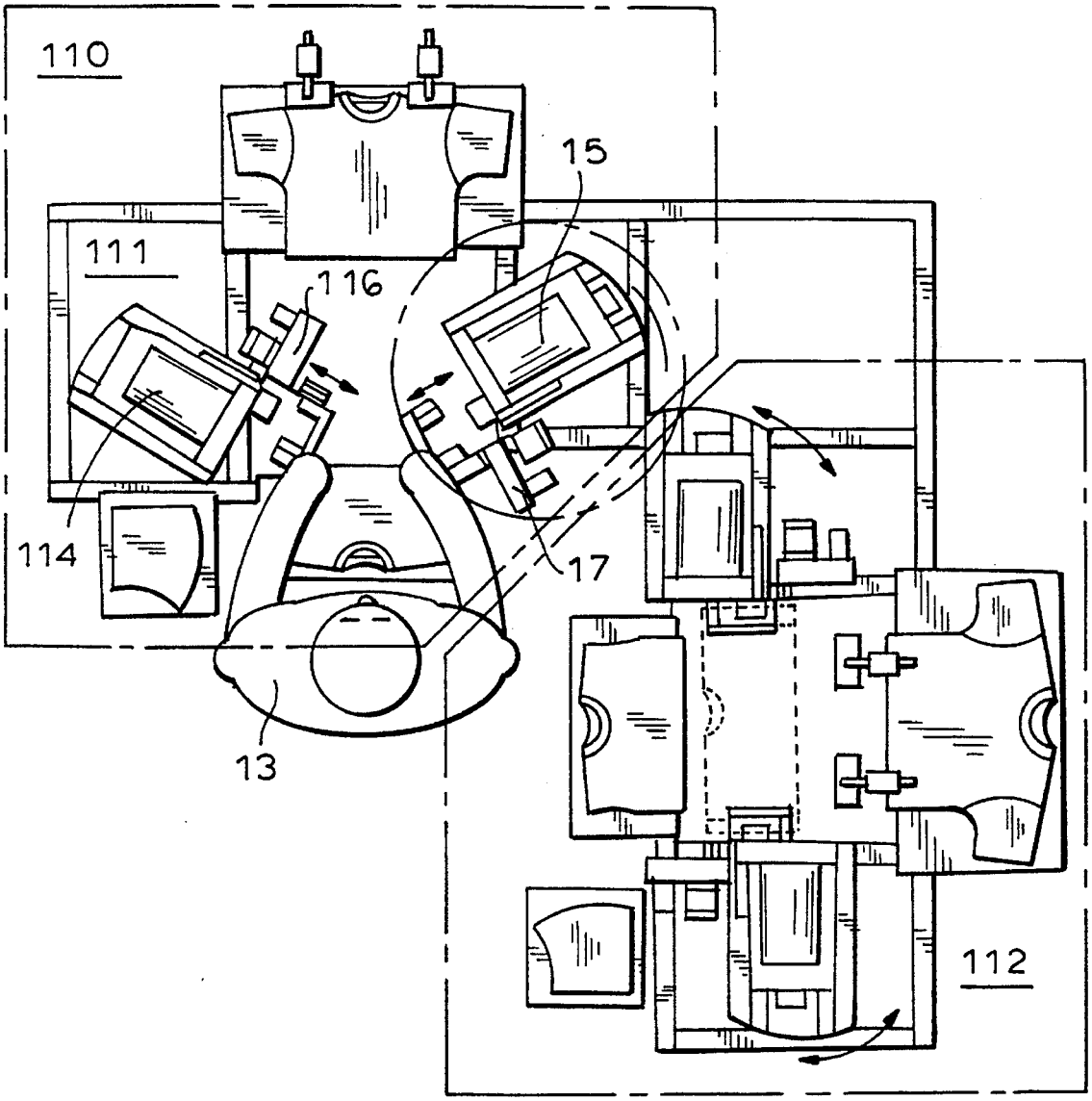
FIG. 9 is a top plan view, similar to FIG. 1, of a second preferred embodiment of the invention.

During the loading procedure, the load fixtures 16,17, and their related sewing heads 14,15 advantageously are pivoted to partially face the operator 13, as shown in FIG. 1. In addition, the load fixtures advantageously are moved outward toward each other and toward the operator, both to be more conveniently positioned with respect to the operator for the loading operations, and also to simplify the procedure of loading the shirt body shoulder openings at opposite sides into each of the load fixtures. After the loading operations have been completed on both sides, the load fixtures 16,17 are retracted, bringing the sewing heads into position, in the region of the sewing shutter between the active edge guide rollers 22,32 and the idler roller 20. This is shown in FIG. 7 of the drawings. If desired, it may be beneficial to actuate the respective aligning rollers 22,32 to advance the respective sleeve and shirt body sections a short distance before commencing sewing to assure proper initial alignment of the fabric edges in the region of the sewing axis 40.

In the form of the invention illustrated in FIGS. 1–8, it is contemplated that the two sewing heads 14,15 will be of conventional design. Accordingly, since the two machines are facing in opposite directions, the sewing direction at one side will be opposite to the sewing direction at the other side. In the first illustrated form of the invention, this accommodated by performing the sewing operations at opposite sides on a sequential basis. For example, the first sewing operation may take place on the right-hand side, by activating the sewing head 15. The sleeve edge margin 36 and the right-hand shoulder margin 35 of the shirt body are advanced through one complete rotation while the sleeve section 28 is sewed to the shirt body 33. Preferably, the sleeve section and shoulder margin at the opposite side are held stationary during this operation, resulting in a twisting action on the shirt body, as reflected in FIG. 1, sewing station 12.

As a sewing operation proceeds, the shirt body shoulder margin 35 and sleeve margin 36 are advanced toward the sewing head, in the direction of the arrows in FIG. 7. As the respective fabric sections are advanced toward the sewing point 40, the locations of their respective edges are independently detected by the sensors 37,38 and independently adjusted as necessary by the active edge guide rollers 22,32.

As sewing proceeds and nears completion, the sewed seam advances to a point approaching the separator plate 31. At this stage, the separator plate 31 is retracted, along with the upper active guide roll 32, which can not function properly without the presence of the separator plate. Desirably, the separator plate is replaced by a friction plate 44, shown in FIG. 8, which is applied externally of the shirt body fabric and presses both layers of fabric toward the lower active aligning roller 22. The roller 22 can thus continue to drive and guide the fabric during the last portion of the sewing operation. While it is not possible, during this last sewing portion, to adjust the edges of the two fabric sections independently, this generally is not a problem inasmuch as the edges have been previously aligned over most of the length of the hem, and typically the alignment of the remaining, unsewed portion of the edges typically are quite well aligned and the absence of active independent alignment of the edges over that short distance is inconsequential. The position of the two edges can, of course, be adjusted together during this final portion of the cycle by operation of the sensor 37 and the active edge guide roller 22.

When the first shoulder seam has been completed, the sewing head 15 is deactivated. The sewing of the opposite side may now commence, with the opposite side sleeve section and shoulder margin rotating in the opposite direction with respect to the first (already sewn) side for one full revolution until the second shoulder seam has been completed. At this time, the opposite side sewing head 14 is deactivated.

During the sewing of the second shoulder seam, the active edge aligning roller 22 supporting the first, already sewn shoulder seam, is rotated in reverse, that is, in the same direction as the rotation during the second sewing operation. This reverse rotation is at a speed equal to twice the sewing speed so that, at the end of the second sewing operation, the single revolution of twist, imparted to the shirt body 33 during the first sewing operation, is completely removed, and the completed shirt is ready for stacking.

When the sewing has been completed at both sides, stacking clamps 42 are moved in to engage the completed shirt in the shoulder area, to draw a completed shirt off of the load fixtures and carry it to a stacking area 43.

In a modified version of the procedure described above, the reverse rotation of the first shoulder seam can be eliminated by engaging the tail of the shirt with stacking clamps 42 prior to initiating the first sewing operation. Upon completion of the first sewing operation, the shirt is permitted to simply fall off of the first load fixture 17. Sewing may then proceed at the opposite side, while the first load fixture is rotated toward the operator in readiness for a new loading operation. At the completion of the second sewing operation, the shirt is released by the second load fixture 16 and is carried away by the stacker mechanism.

The system shown in FIG. 1 is greatly simplified in comparison to previous systems, yet is capable of highly efficient production of completed shirts, at much higher overall speeds than have been obtained heretofore. In the arrangement shown in FIG. 1, with two sewing stations arranged to be closely adjacent and at right angles, the operator is provided with a supply 44 of shirt bodies directly in front of the sewing position, and a supply of sleeve sections 45 at one side. Similar supplies are provided in front of each of the sewing stations. Accordingly, as soon as the operator has loaded a shirt body and two sleeve sections at one sewing station, he or she simply turns to the adjacent station and proceeds with the loading operations for that station. With the arrangement shown in FIG. 1, it is possible for a single operator to produce completed shirts on an eight second cycle, which is possibly the fastest known to the industry at this time.

In the form of the invention shown in FIGS. 9–14, modifications are made to each of the sewing stations to enable the sewing motion of the sleeve sections and shirt body to take place with the same directional motion, so that sewing at opposite sides of the shirt body can take place simultaneously. In the installation illustrated in FIG. 9, the general layout of an installation 110 can be same as in FIG. 1, with two sewing stations 111,112 arranged for servicing by a single operator 13. The arrangement of the sewing heads 15 and load fixture 17, at the right-hand side, is identical to that described in connection with FIGS. 1–8. At the left side, however, the load fixture 116 and sewing head 114 are arranged in a modified configuration, such that the sewing head at the left side operates on the inside lower portion of the sleeve and shoulder opening, while the right side sewing head operates on the outside upper portion of the shirt body and sleeve section.

Figure 10:
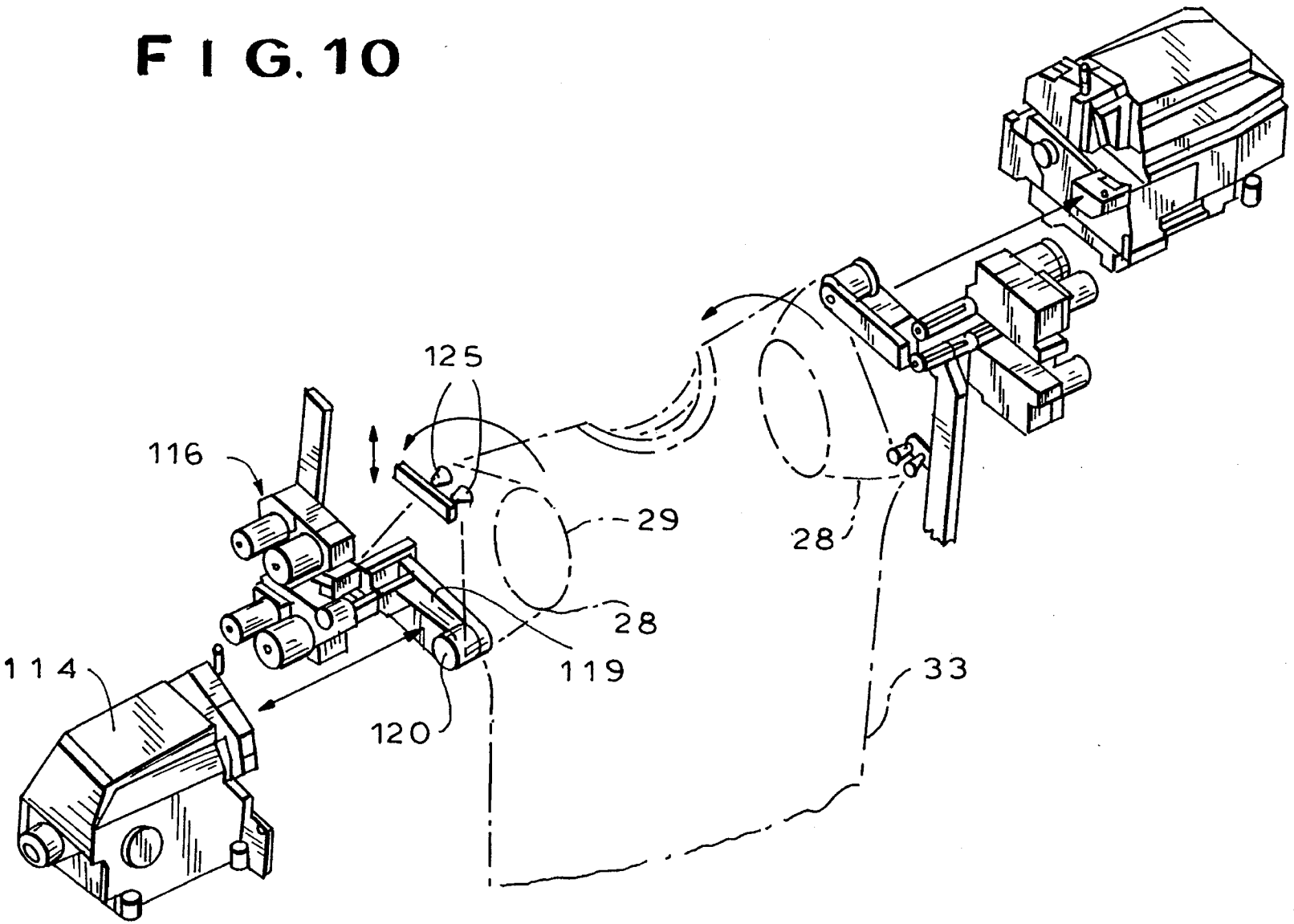
FIG. 10 is a simplified perspective representation of a sewing station, forming part of the system of FIG. 9, illustrating the sewing head at one side positioned to operate on the outside of the sleeve opening, and the sewing head on the opposite side positioned to operate on the inside of the sleeve opening, enabling the sewing to proceed at both sides simultaneously.
Figure 15:
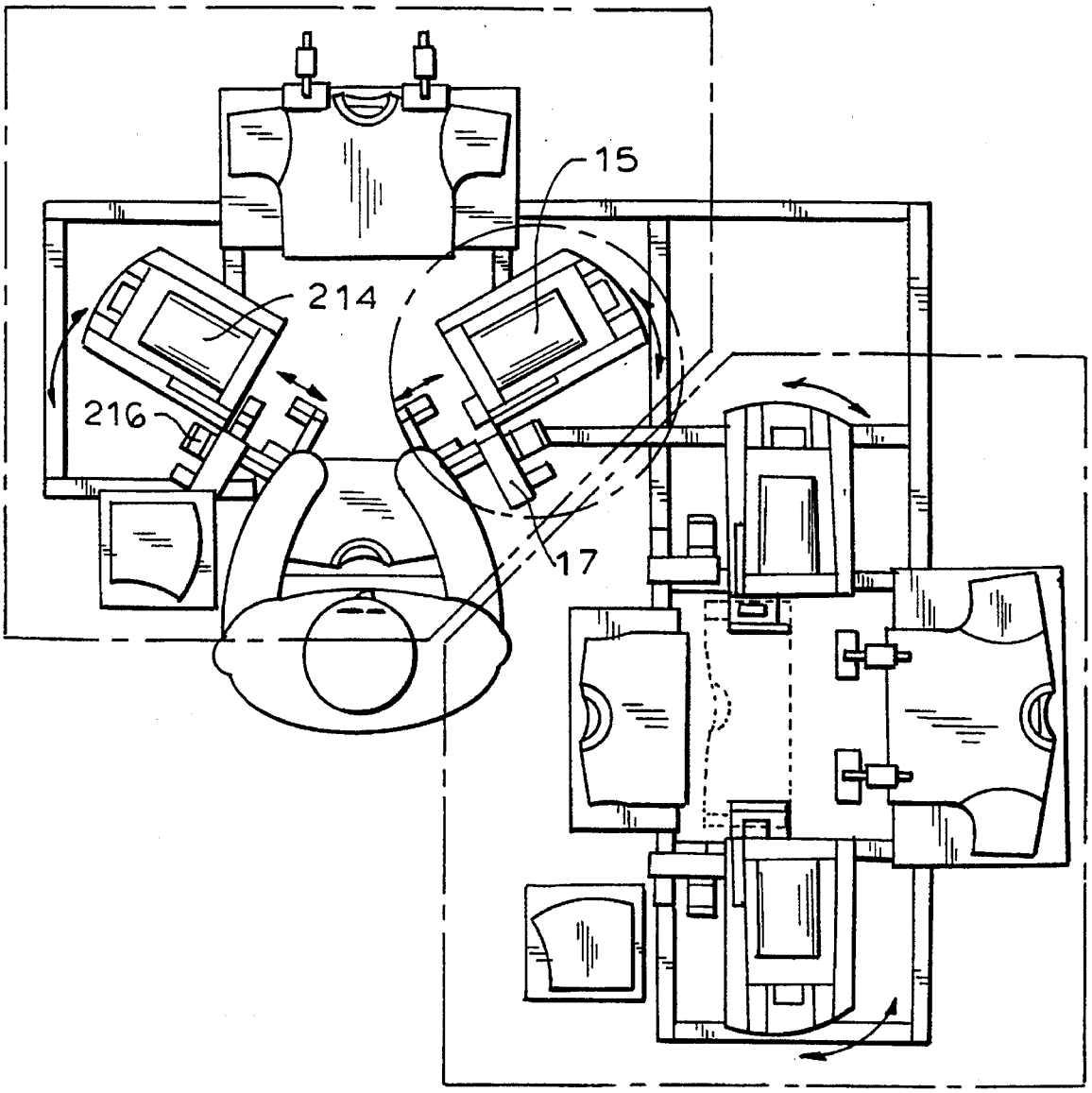
FIG. 15 is a top plan view of yet another preferred embodiment of the invention wherein the installation is provided with sewing heads arranged to run in opposite directions, enabling opposed sewing stations to be set in a symmetrical arrangement and for sewing to proceed simultaneously at both sides.
Figure 16:
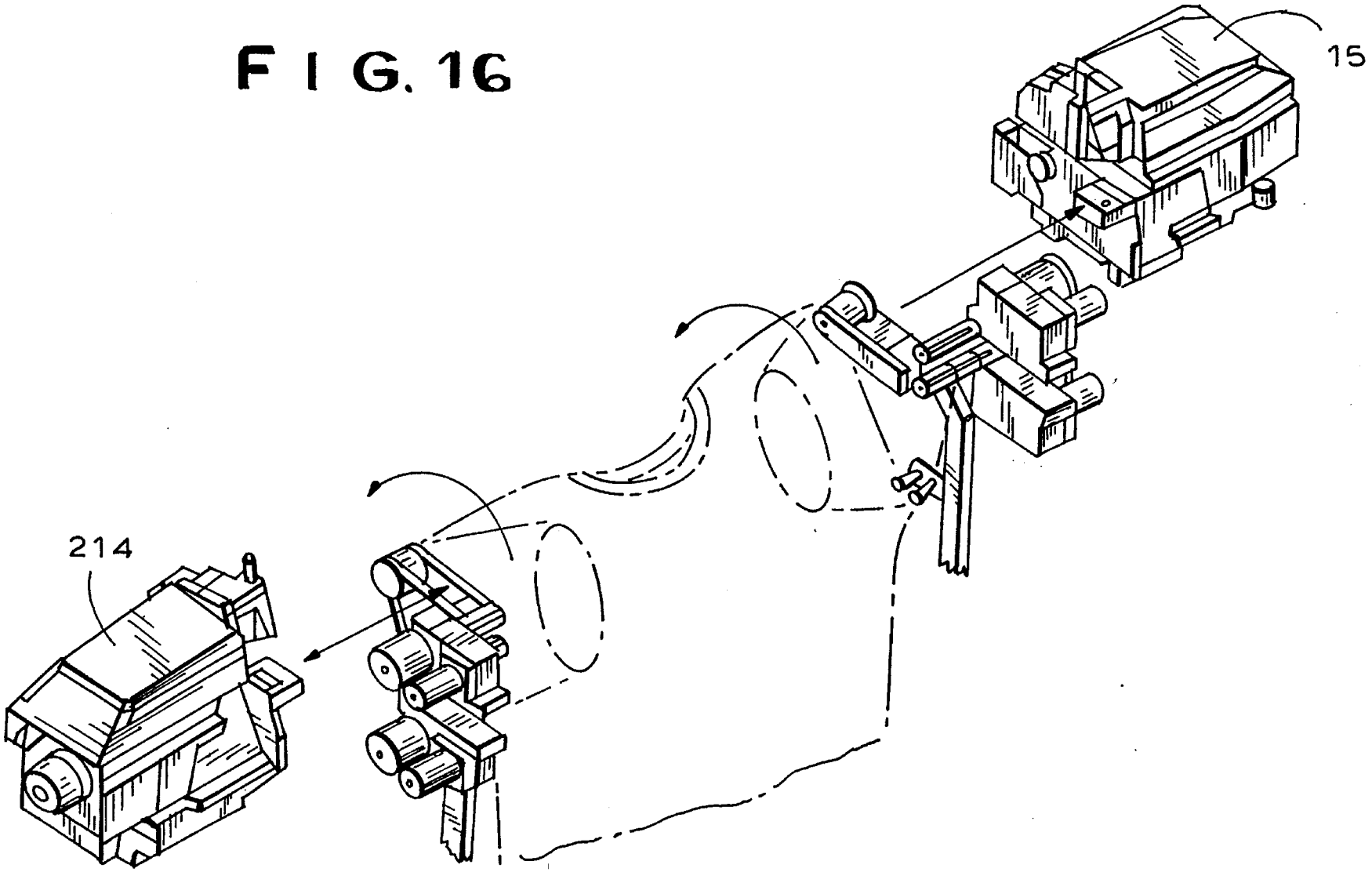
FIG. 16 is a simplified perspective representation of a sewing installation in the system of FIG. 15.
Figure 18:
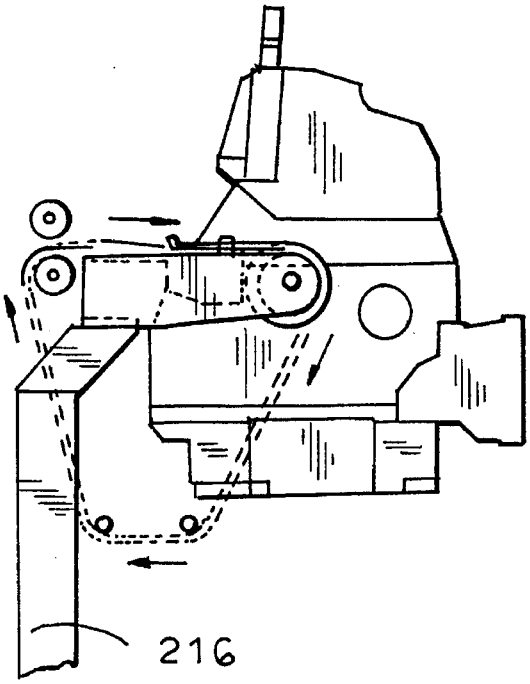
FIGS. 17, 18 are elevational views of the opposed load fixtures, incorporated in the system of FIG. 15, after loading of the fixtures and with the sewing heads in position for sewing.
Figure 17:
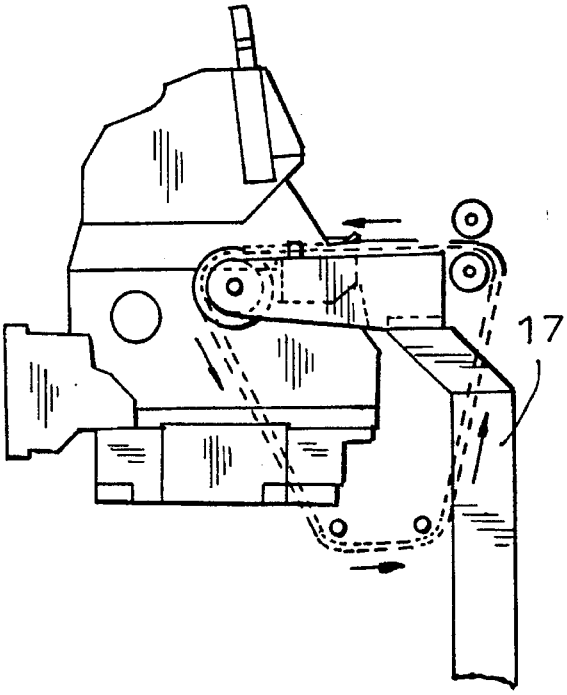

As reflected in FIG. 10, the load fixture 116, at the left side, is mounted essentially with an upside-down orientation, with frustoconically shaped tensioning guide rollers 125 being positioned above the sewing plane as defined by idler roller 120 and active edge guide roller 122 (FIG. 12). The sewing head 114 is positioned to operate on the lower portion of the sleeve opening, as shown in FIGS. 10 and 14. In all other respects, the function and operation of the equipment is the same as described in connection with FIGS. 1–9.

In the modification of FIGS. 9–14, because of the inverted orientation of the load fixture at one side and modified positioning of the sewing head at that side, rotation of the shirt body and sleeve sections during sewing operations is in the same direction at both sides. Accordingly, after loading of a shirt body and sleeve sections at both sides, sewing at both sides may take place simultaneously.

In the embodiment shown in FIGS. 15–18, the right side sewing head 15 and load fixture 17 can be the same as in the embodiment of FIGS. 1–8. At the left side, a modified sewing head 214 and load fixture 216 are provided to enable sewing of opposite sides with rotation of the shirt body and sleeve sections in the same direction, so that, as in the embodiment of FIGS. 9–14, sewing can take place simultaneously at both sides.

In the form of the invention shown in FIGS. 15–18, the sewing head 15, at the right side, is a conventional "right-hand" machine while the sewing head 214 is a "left-hand" machine which sews in the opposite direction from the sewing head 15.

The load fixture 216, at the left side, is constructed the same as the load fixture 17 at the opposite side, but is a mirror image thereof to accommodate the direction of sewing. The form of the invention of FIGS. 15–18 can simplify the operators loading tasks, as compared to the modification of FIGS. 9–14, in that the general orientation of the load fixtures 216, 17 are the same at both sides, and both sewing heads 214, 15 are operating on the assembled shirt components in the same manner. Currently, however, left-hand sewing heads are not commercially available, and the modifications required to convert a right-handed sewing head for left-handed operation makes the system relatively costly, as compared to systems using exclusively the more conventional right-handed machines.

Figure 19:
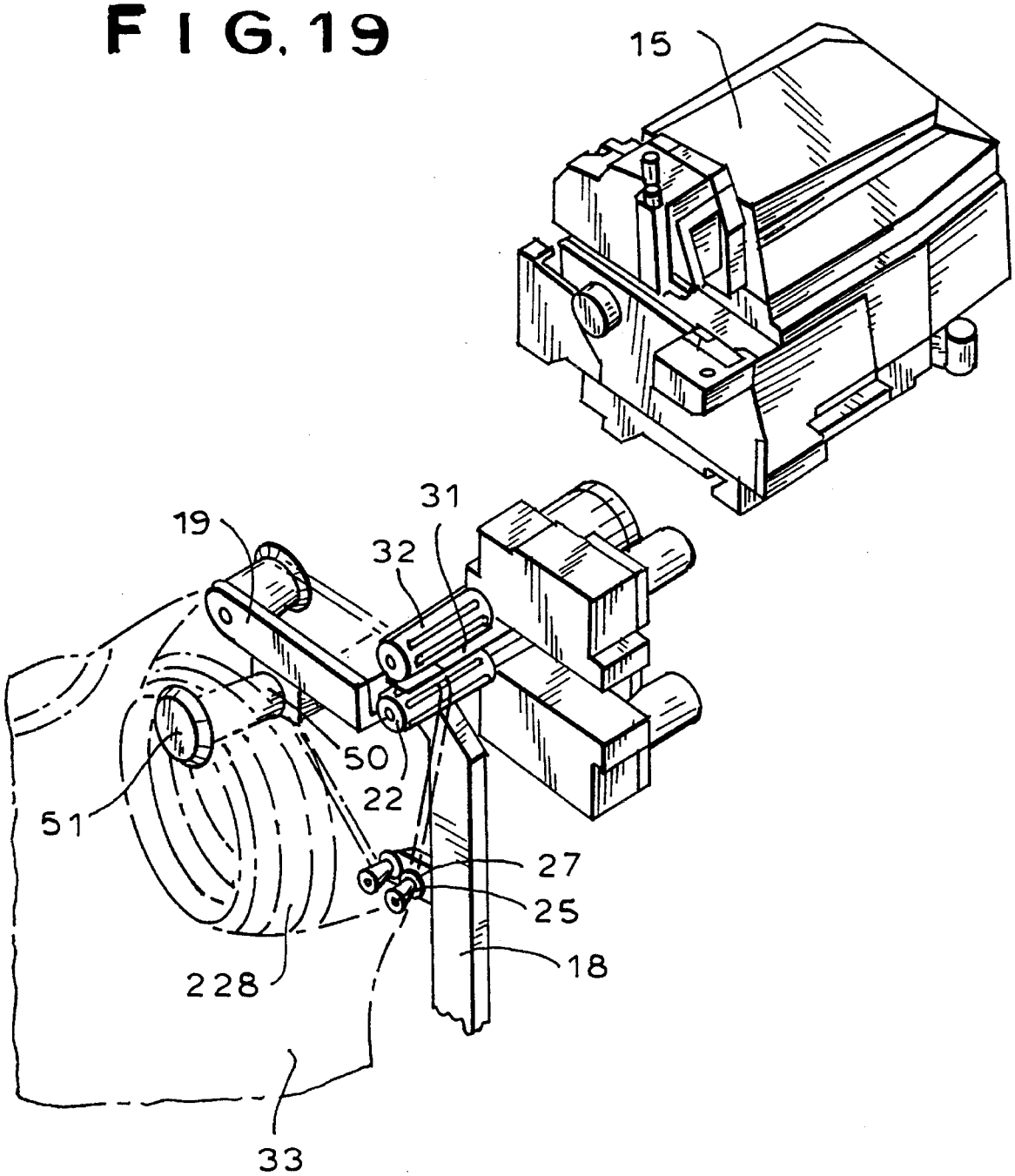
FIG. 19 is a fragmentary perspective view of a load fixture configured for processing of long-sleeved shirts.

In the modification of FIG. 19, provision is made for the production of shirts with long sleeves. In any of the previously described forms of the invention, a characteristic feature is that only narrow marginal edge portions of the sleeve sections and shirt bodies are supported and controlled during the sewing operations. In order to better accommodate the production of shirts with long sleeves, it is advantageous to provide a stationary support arm 50, which extends outward from the sewing shutter 19 for a short distance (e.g., a few inches) and is provided with a confining flange 51 at its outer end. When an operator loads a long sleeve section 228 onto the apparatus of FIG. 19, the operator applies the raw edge margin over the rollers 20,22 and 25 in the manner previously described. The outer portions of the long sleeve section 228 are telescopically gathered by the operator and simply draped over the stationary support 50, being confined thereon by the outer flange 51. During the sewing operations, the sleeve section 228 is both confined and supported during its rotation. As will be understood, the support device shown in FIG. 19 may be employed in any of the versions of the invention described herein.

The system of the invention represents a significant improvement in the production of knitted shirts by effectively automating the sleeve insertion operation in a manner that enables the production to be accomplished at much greater speeds than heretofore, while at the same time the required equipment is more simplified and more economical than has been proposed heretofore. By providing for the support and control of the sleeve sections and the shirt body shoulder openings only in relatively narrow marginal edge areas throughout the sewing process, the necessary loading operations are greatly simplified, as is the equipment required. The equipment utilized in carrying out the invention is universal as to size in that a single piece of equipment can process shirts throughout the full range of sizes without requiring special forms or adapters for different sizes or different groups of sizes.

To particular advantage, the method and apparatus of the invention do not require excessive stretching of any of the components during the sewing and loading operations. Because the relatively smaller diameter hemmed outer ends of the sleeve sections are not actively engaged during the loading and sewing operations, there is no need to distort them at all at any stage of the operations. While desirably the edges of the sleeve sections and shirt body shoulder openings to be sewn are maintained under tension during the sewing operations, the tension is very light, sufficient only to assist in edge guiding operations and to assure that the two components to be sewn together have equal circumference dimensions during the sewing operations.

With the method and apparatus of the invention, the loading of the sleeve section and shirt body components onto a load fixture for sewing is greatly expedited by the fact that only a narrow margin of the fabric has to be loaded, and only minimal attention has to be paid to initial accurate alignment because of the active alignment of the edges throughout the sewing operations. The ease and efficiency of loading is even further enhanced by mounting of the load fixtures for limited pivoting motion, so that they can be pivoted toward the operator for loading, and then pivoted back to aligned positions to accommodate the sewing operations.

The invention accommodates the insertion of long sleeves as well as short sleeves with nearly equal ease and efficiency.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) first and second spaced apart and generally opposed sewing stations, (b) each of said sewing stations comprises a plurality of sleeve section guide elements adapted for the reception and guidance of a shoulder margin of a sleeve section, (c) at least one of said sleeve section guide elements being movable to place said sleeve section shoulder margin under controlled tension, (d) at least one of said sleeve section guide elements including means for controllably laterally adjusting the position of said sleeve section shoulder margin in preparation for a sewing operation, (e) each of said sewing stations further comprising a plurality of shirt body guide elements adapted for the reception and guidance of a shoulder margin of a shirt body in surrounding relation to said sleeve section, (f) at least one of said shirt body guide elements being movable to place said shirt body shoulder margin under controlled tension, (g) at least one of said shirt body guide elements including means for controllably laterally adjusting the position of said shirt body shoulder margin in preparation for a sewing operation, (h) means for maintaining separation between the respective sleeve section and shirt body shoulder margins in regions adjacent to the guide elements at which the respective shoulder margins are adjusted in preparation for sewing.

2. An apparatus according to claim 1, wherein (a) said sewing stations are normally aligned on generally parallel axes for sewing, and (b) at least one of said sewing stations is mounted for pivoting movement about a vertical axis to facilitate loading.

3. An apparatus according to claim 1, wherein (a) the movable sleeve section guide element and the movable shirt body guide element comprises a common element guiding both said sleeve section and said shirt body.

4. An apparatus according to claim 1, wherein (a) said first and second sewing station comprises sewing heads of the same type positioned in opposed relation and in the same orientation, whereby one of said sewing heads sews in a forward direction and the other sews in a rearward direction, and (b) control means for operating said sewing heads in succession, whereby said shirt body is rotated first in one direction, during sewing of one sleeve section, and then in the other direction, during sewing of the other sleeve section.

5. An apparatus according to claim 1, wherein (a) said first and second sewing stations comprises sewing heads of the same type, (b) one of said sewing heads being positioned to operate at the outside of the shirt body shoulder margin, (c) the other of said sewing heads being positioned to operate at the inside of the sleeve section shoulder margin, whereby simultaneous operation of said sewing heads results in rotation of said shirt body and sleeve sections in the same direction at both sides.

6. An apparatus according to claim 1, wherein (a) said first and second sewing stations comprise left and right hand sewing heads, whereby simultaneous operation of said sewing heads results in rotation of said shirt body and sleeve sections in the same direction at both sides.

7. An apparatus according to claim 1, wherein (a) said plurality of sleeve section guide elements and shirt body guide elements define respective two dimensional paths for said sleeve section shoulder margins and said shirt body shoulder margins, with the latter surrounding the former, and (b) each said sewing station includes a projecting sleeve support, mounted to project within said two dimensional paths, for supporting sleeve sections during rotation thereof in the course of sewing.

8. An apparatus according to claim 7, wherein (a) said sleeve supports are of shorter length than said sleeve sections, and (b) said sleeve supports are provided with retaining flanges at respective outer ends thereof for retaining sleeve sections in longitudinally gathered condition during sewing.

9. Apparatus for sewing knitted sleeve sections to knitted shirt bodies, where the shirt bodies are formed at opposite sides with sleeve openings of the approximate size and shape of an end of a sleeve section to be secured thereto, and where said sleeve sections are supplied with a right-side-out orientation and said shirt bodies are supplied with an inside-out orientation, which comprises (a) at least one sewing station comprising a plurality of sleeve section guide elements adapted for the reception and guidance of a relatively narrow shoulder margin of a sleeve section, (b) at least one of said sleeve section guide elements being movable to place said sleeve section shoulder margin under controlled tension, (c) at least one of said sleeve section guide elements including means for controllably laterally adjusting the position of said sleeve section shoulder margin in preparation for a sewing operation, (d) said sewing station further comprising a plurality of shirt body guide elements adapted for the reception and guidance of a relatively narrow shoulder margin of a shirt body in surrounding relation to said sleeve section, (e) at least one of said shirt body guide elements being movable to place said shirt body shoulder margin under controlled tension, (f) at least one of said shirt body guide elements including means for controllably laterally adjusting the position of said shirt body shoulder margin in preparation for a sewing operation, (h) means for maintaining separation between the respective sleeve section and shirt body shoulder margins in regions adjacent to the guide elements at which the respective shoulder margins are adjusted in preparation for sewing.

10. An apparatus according to claim 9, wherein (a) said plurality of sleeve section guide elements and shirt body guide elements define respective two dimensional paths for said sleeve section shoulder margins and said shirt body shoulder margins, with the latter surrounding the former, and (b) said sewing station includes a projecting sleeve support, mounted to project within said two dimensional paths, for supporting a sleeve section during rotation thereof in the course of sewing.

11. An apparatus according to claim 9, wherein (a) said apparatus includes a second sewing station spaced from and generally opposed to the first sewing station, and (b) said sewing stations are mounted for limited pivoting movement about vertical axes between first positions, in which said sewing stations are generally aligned for sewing, and second positions, in which said sewing stations are pivoted toward an operator position to facilitate loading of sleeve sections and shirt bodies.

12. An apparatus according to claim 11, wherein (a) said sewing stations include load fixtures movable toward and away from said operator position to facilitate loading operations.

13. An apparatus according to claim 12, wherein (a) said load fixtures each include at least three guide rollers and a frame structure for mounting said guide rollers, and (b) each said load fixture being mounted for controllable movement away from a sewing head associated therewith, to facilitate loading operations, and toward said sewing head to facilitate sewing.

14. An apparatus according to claim 13, wherein (a) said guide elements comprising at least one active edge guide roller adapted for rotation to advance an edge margin toward a sewing position and further adapted to effect lateral adjustment of said edge margin, (b) said guide elements comprising at least one guide roller configured to have a larger diameter toward an outer end thereof, and to have a flange at an inner end thereof, whereby to urge an edge margin, supported thereon under light tension, toward said flange, (c) said last mentioned guide element supporting edge margins of a sleeve section and a shirt body and serving as a coarse alignment means for said edge margins.

15. The method of sewing knitted sleeve sections to knitted shirt bodies, which comprises, (a) providing said sleeve sections with a right-side-out orientation and shirt bodies with an inside-out orientation, (b) said shirt bodies being formed at opposite sides with sleeve openings of the approximate size and shape of an end of a sleeve section to be secured thereto, (c) mounting a shoulder edge margin of a sleeve section on a load fixture by placing said sleeve edge margin over at least two guide rollers forming part of said load fixture, (d) thereafter moving one of said guide rollers in a direction away from the other to place said sleeve edge margin under light controlled tension, (e) loading one side of a shirt body onto said load fixture, in surrounding relation to said sleeve section and with a shoulder margin of said shirt body being engaged by at least two guide rollers including said one guide roller, and (f) independently edge guiding the respective shoulder margins while advancing said edge margins to a sewing head.

16. The method of claim 15, which includes the further steps of (a) mounting a shoulder edge margin of a second sleeve section on a second load fixture by placing said sleeve edge margin over at least two guide rollers forming part of said second load fixture and being positioned in spaced relation to and generally opposite to the rollers of said first load fixture, (b) thereafter moving one of said last mentioned guide rollers in a direction away from the other to place said second sleeve edge margin under light controlled tension, (c) loading the other side of said shirt body onto said second load fixture, in surrounding relation to said second sleeve section and with a second shoulder margin of said shirt body being engaged by at least two guide rollers including said one guide roller, (d) independently guiding the last mentioned respective shoulder margins while advancing said edge margins to a sewing head, and (e) effecting the sewing of each of said sleeve sections to said shirt body while the other of said sleeve sections is being held by a load fixture.

17. The method of claim 16, wherein (a) the first and second sleeve sections are sewed to said shirt body in sequential operations.

18. The method of claim 17, wherein (a) one sleeve section is held stationary while the other is rotated during sewing.

19. The method of claim 17, wherein (a) during the sewing of said second sleeve section, said first sleeve section is rotated in the same direction as said second sleeve section and at twice the speed.

20. The method of claim 16, wherein (a) the sewing heads for the respective sleeve sections are constructed or oriented such that said sleeve sections both rotate in the same direction during sewing, and (b) the first and second sleeve sections are sewed to said shirt body in simultaneous operations.

21. The method of claim 20, wherein (a) similar sewing heads are provided at opposite sides for sewing the respective sleeve sections, (b) the sewing head at one side being positioned to sew along the outside of a shirt body shoulder margin, and (c) the sewing head at the other side being positioned to sew along the inside of a sleeve section shoulder margin.

22. The method of claim 20, wherein (a) the sewing head at one side is a right hand sewing head and the sewing head at the other side is a left hand sewing head, and (b) the sewing heads at both sides are positioned to sew along the outside of a shirt body shoulder margin.

23. The method of claim 16, wherein (a) said load fixtures are moved toward each other for loading and thereafter retracted to sewing positions.

24. The method of claim 15, wherein (a) said sleeve sections are gathered lengthwise and supported internally for rotational motion during sewing.

25. The method of claim 24, wherein (a) said sleeve sections are full length sleeves.

26. The method of claim 15, which includes the further steps of (a) mounting a shoulder edge margin of a second sleeve section on a second load fixture by placing said sleeve edge margin over at least two guide rollers forming part of said second load fixture and being positioned in spaced relation to and generally opposite to the rollers of said first load fixture, (b) thereafter moving one of said last mentioned guide rollers in a direction away from the other to place said second sleeve edge margin under light controlled tension, (c) loading the other side of said shirt body onto said second load fixture, in surrounding relation to said second sleeve section and with a second shoulder margin of said shirt body being engaged by at least two guide rollers including said one guide roller, (d) independently guiding the last mentioned respective shoulder margins while advancing said edge margins to a sewing head, (e) effecting the sewing of a first one of said sleeve sections to said shirt body while the other of said sleeve sections is being held by a load fixture, and (f) releasing said shirt body and first sleeve section from said first mentioned load fixture prior to the sewing of said second sleeve section.

27. The method of claim 26, wherein (a) said shirt body is engaged by stacking means prior to initiation of sewing operations, and (b) said shirt body is removed from said second load fixture by said stacking means following sewing of said second sleeve section.

* * * * *